United States Patent [19]

Healy

[11] 4,095,626

[45] Jun. 20, 1978

[54] VAPOR RECOVERY IN A LIQUID DISPENSING UNIT

[76] Inventor: James W. Healy, 54 Plymouth Rd., Wakefield, Mass. 01880

[21] Appl. No.: 808,617

[22] Filed: Jun. 21, 1977

Related U.S. Application Data

[63] Continuation-in-part of Ser. No. 553,529, Feb. 27, 1975, Pat. No. 4,057,086, and Ser. No. 656,124, Feb. 9, 1976, Pat. No. 4,056,131.

[51] Int. Cl.[2] ..... B65B 57/14

[52] U.S. Cl. ..... 141/206; 141/46; 417/182.5

[58] Field of Search ..... 141/59, DIG. 1, 97, 141/52, 392, 287, 41, 42, 307, 310, 290, 383–386, 206–229, 301, 302, 39–44, 59, 387–890, 198–203, 46; 417/79, 182.5; 285/263, 272; 403/50, 51

[56] References Cited

U.S. PATENT DOCUMENTS

| | | | |
|---|---|---|---|
| 3,810,714 | 5/1974 | Turner | 417/182.5 |
| 3,814,148 | 6/1974 | Wostl | 141/392 |
| 3,840,055 | 10/1974 | Wostl et al. | 141/392 |
| 3,866,636 | 2/1975 | Lasater | 141/392 |
| 3,899,009 | 8/1975 | Taylor | 141/97 |
| 3,915,206 | 10/1975 | Fowler et al. | 417/79 |

*Primary Examiner*—Houston S. Bell
*Attorney, Agent, or Firm*—W. R. Hulbert

[57] ABSTRACT

Vapors displaced from a volatile liquid container, such as a vehicle's fuel tank, during refilling of the container are recovered by a system employing a liquid jet gas pump to produce a suction in a vapor removal conduit. The liquid jet gas pump draws the vapors through the vapor conduit at a velocity which is sufficient to remove any liquids in the conduit, thereby preventing blockage of the conduit. Valving arrangements in the liquid jet gas pump make the system compatible with leak detection devices and regulate the vacuum in the vapor conduit to a predetermined maximum.

9 Claims, 2 Drawing Figures

VAPOR RECOVERY IN A LIQUID DISPENSING UNIT

CROSS-REFERENCE TO RELATED APPLICATION

This application is a continuation-in-part of my U.S. patent application Ser. No. 553,529, "Vapor Control", filed Feb. 27, 1975, now U.S. Pat. No. 4,057,086, and of my U.S. patent application Ser. No. 656,124, "Vapor Control in a Fuel Dispensing Nozzle", filed Feb. 9, 1976, now U.S. Pat. No. 4,056,131, the benefit of which filing dates are herein claimed.

FIELD OF THE INVENTION

This invention relates to vapor recovery systems for preventing the escape of vapors to the atmosphere during the refilling of a volatile liquid container from a dispensing apparatus. In particular, this invention deals with a vapor recovery system for preventing the escape of hydrocarbon vapors from a vehicle's fuel tank during refueling from a service station's fuel dispensing unit.

BACKGROUND OF THE INVENTION

A number of systems have been proposed for dealing with the vapors displaced from a volatile liquid container while it is being refilled, such as the hydrocarbon vapors displaced from a vehicle's fuel tank during a refueling operation.

Previous vapor recovery systems for recovering hydrocarbon vapors from a vehicle's fuel tank have included passages in the dispensing nozzle for collecting vapors from the fuel tank, as well as a vapor return line for delivery of the collected vapors to the reservoir. Each of these prior systems, however, has suffered from one or more of various drawbacks.

Some of these systems have relied solely upon vapor pressure within the fuel tank to push the vapor through the vapor return line. Such systems required a large and cumbersome vapor return line to minimize resistance to vapor flow. Additionally, when that return line became blocked by liquid (e.g., from fuel splashback or condensation), the vapor pressure developed in the vehicle fuel tank was usually insufficient to overcome the blockage. The result was vapor leakage to the atmosphere at the nozzle-fuel tank interface.

Other systems used for fuel dispensing have employed a vacuum-assist for drawing vapor through a vapor return line. To avoid the expense of a separate vacuum pump at each dispensing station, such systems have typically resorted to a powerful, continuously-operating blow-type vacuum pump and a complicated arrangement of electrically actuated valves for connecting the various vapor return lines to the vacuum pump when the various pumps were actuated for dispensing. Acceptance of these systems has been minimal because of the expense and difficulty of both installation and maintenance. Additionally such systems typically draw such a large volume of ambient air, relative to the volume of fuel vapor, that there is a danger of an explosive mixture being formed.

Finally, it has been suggested that each dispensing unit include a vacuum pump driven by the dispensing unit's conventional meter and connected to a vapor return line. However, the well-known fragility of such meters renders suspect the practicality of this suggestion.

SUMMARY OF THE INVENTION

I provide a simple, foolproof, and inexpensive vapor recovery system for use with systems for dispensing volatile liquids, such as liquid fuels, from a reservoir wherein the liquid is pumped under pressure through a hose and discharged through a vapor recovery dispensing nozzle into the inlet of a container, such as a fuel tank, the novel vapor recovery system comprising a liquid jet gas pump having its liquid inlet in communication with the pressurized liquid so as to receive a portion thereof, and a vapor conduit having one end in the nozzle and adpated to be placed in communication with the interior of the container when the nozzle is inserted into the inlet and the other end in communication with the vapor inlet of the jet pump, the outlet of the jet pump discharging into the reservoir, whereby vapor displaced from the container as it is filled will be drawn off through the conduit by suction created by the passage of the liquid through the jet pump.

In preferred embodiments the vapor conduit comprises a second hose having a predetermined outer diameter less than the inner diameter of the first hose and disposed within the first hose; the second hose has an inner diameter of about 5/16 inch and an outer diameter of about ½ inch; the vapor conduit has a predetermined inner diameter and the jet pump generates a predetermined degree of suction cooperating to produce a vapor velocity in the vapor conduit sufficient to entrain any liquid in the vapor conduit; the vapor conduit has an inner diameter of 5/16 inch and the jet pump generates a suction in the range of 16 to 20 inches of water; a pilot valve is provided in a passage within the jet pump, between its liquid inlet and its outlet; the pilot valve is biased to a closed configuration in absence of a predetermined threshold pressure in the passage and moves to an open position when the threshold pressure is reached; a needle valve is provided in the passage; the needle valve is biased toward a first position in which delivery of liquid through the jet pump is substantially unblocked, and the needle valve moves toward a second position which increasingly blocks the flow of liquid through the jet pump as the vacuum within the vapor conduit increases.

My invention is useful for many types of systems for dispensing volatile liquids, and is especially useful for a fuel service station's conventional dispensing units. It is easily and inexpensively installed in existing dispensing systems, and is compatible with systems having conventional leak detection devices. It provides for reliably effective vapor removal without forming an explosive mixture or endangering the container being filled by exposing it to excessive vacuum levels which could cause it to collapse.

Other advantages and features of the invention will be apparent from the description and drawings herein of a preferred embodiment thereof.

DESCRIPTION OF PREFERRED EMBODIMENTS

The structure and operation of a preferred embodiment of the invention is as follows.

STRUCTURE

The drawings show a preferred embodiment, below described.

DRAWINGS

DESCRIPTION

Figure 1:
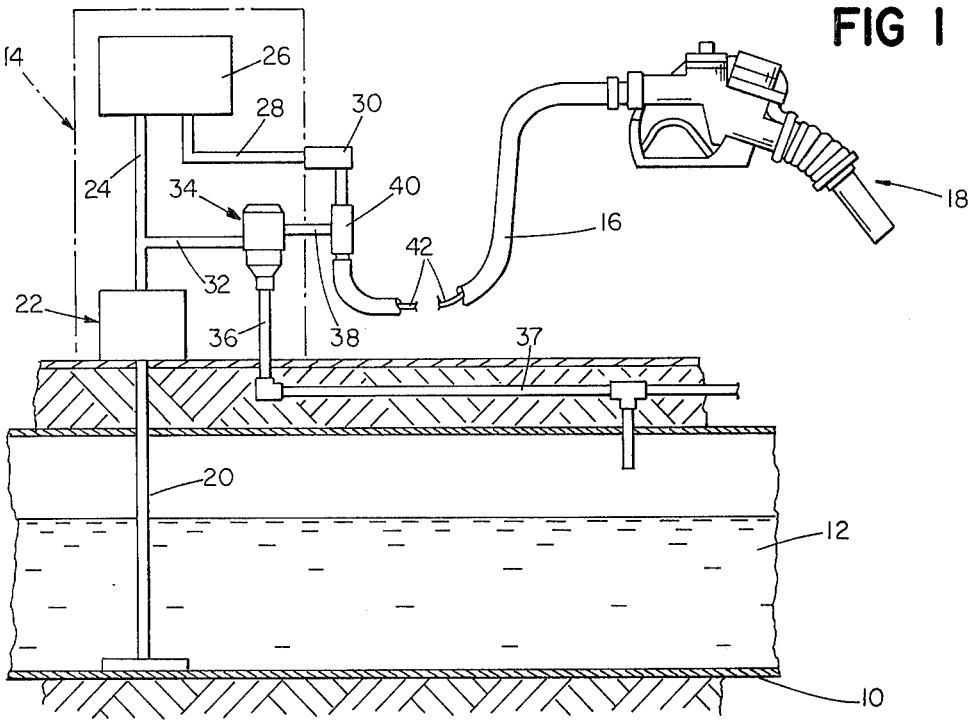
FIG. 1 is a schematic illustration of a fuel dispensing system, such as may be used at a filling station, incorporating features of the present invention.

Turning now to the figures, there is shown in FIG. 1 a generally conventional gasoline dispensing system having an underground reservoir 10 containing a supply of gasoline 12 and a dispensing station comprising a pump housing 14 and a flexible gasoline hose 16 extending between housing 14 and a vapor recovery dispensing nozzle 18. A conduit 20 supplies gasoline 12 from reservoir 10 to a fuel pump 22 disposed within housing 14. The fuel pump output is delivered, via conduit 24, to a conventional meter or computer 26 for measuring the amount of gasoline dispensed. Another conduit 28 delivers gasoline from meter 26 to a fitting 30 connected to flexible hose 16.

According to the present invention, a portion of the liquid fuel delivered by fuel pump 22 is fed by a conduit 32 to liquid jet gas pump 34, the output of which is returned, by pipe 37, to reservoir 10. The suction side of liquid jet gas pump 34 communicates via conduit 38 and fitting 40 to a suction line in the form of a flexible vapor hose 42 disposed within the gasoline hose 16. The hose 42 is connected to a vapor recovery dispensing nozzle 18, such as that described in the above-mentioned U.S. patent application Ser. No. 553,529 or as that in my U.S. patent application Ser. No. 656,124, "Vapor Control in a Fuel Dispensing Nozzle", which I incorporate by reference herein, to receive vapors collected from a vehicle fuel tank being refueled through the nozzle.

For use in a conventional one inch (2.54 cm.) diameter gasoline hose 16, hose 42 has a 5/16 inch (0.79 cm.) inner diameter and ½ inch (1.27 cm.) outer diameter. Hose 42 is formed from a material which will not be degraded by continuous immersion in gasoline over a wide range of temperature. Additionally, it must be sufficiently strong to withstand 20 to 30 psig (1406 to 2109 grams per sq. cm.) external pressure, which is typically developed within conventional hose 16, while conveying vapors internally at vacuum levels of approximately 16 to 20 inches of water. One suitable material which achieves all the above requirements for the hose 42 is polyurethane tubing having dimensions as stated above.

Vapor hose 42, with the characteristics described above, will transmit 1½ standard cubic feet per minute a distance of 16 feet at a velocity of approximately 2800 feet (853 meters) per minute with a pressure differential of approximately 16 to 20 inches (40.64 to 50.80 cm.) of water. This volume of vapor is substantially equivalent to the volume of gasoline delivered to the vehicle fuel tank at a rate of about 11 U.S. gallons (41.6 liters) per minute. Thus, a suction line as described, along with a liquid jet gas pump 34 capable of developing a vacuum of 16 to 20 inches of water, can handle the vapor displaced in the vehicle fuel tank by the liquid gasoline entering at rates up to 11 gallons per minute. Further the vapor velocities developed within vapor hose 42 (e.g., in the range of 1500 to 2800 feet per minute) are sufficient to break up and remove any liquid blocking the vapor hose, thus eliminating that problem.

Conventional gasoline pumps 22 have a pressure setting of approximately 20 psig and an internal liquid bypass system to accommodate variations in fueling rates from the extremes of no flow up to about 11 U.S. gallons per minute when the conventional fuel control valve within dispensing nozzle 18 is at a full open position. The conduit sizes and fluid resistance in the liquid channel defined by conduits 32 and 37 and jet pump 34 are chosen such that approximately 1½ to 2 U.S. gallons (5.7 to 7.6 liters) per minute of gasoline are consumed from the pump discharge. The jet pump is designed to generate the desired pressure differential of 16 to 20 inches of water using a liquid flow rate in the range of approximately 2 gallons per minute of liquid when pumping 1½ cubic feet (0.042 cubic meters) per minute of a saturated air and hydrocarbon vapor mixture.

Figure 2:
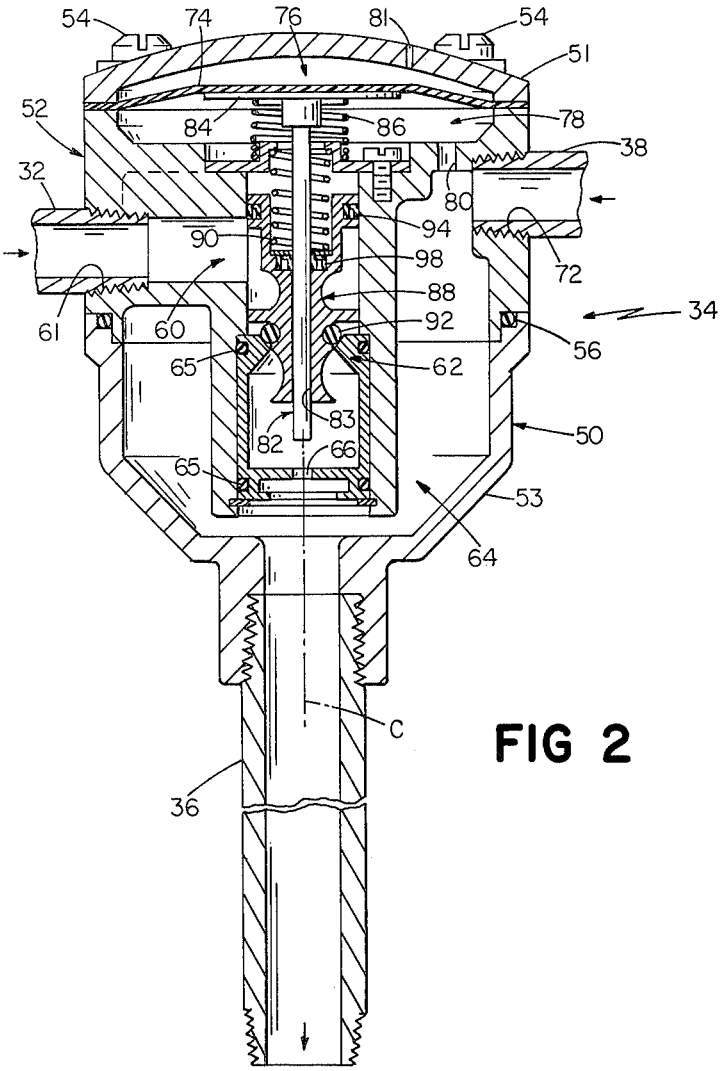
FIG. 2 is a sectional view of a liquid jet gas pump incorporating features of the present invention.

Referring to FIG. 2, the vertically mounted liquid jet gas pump, indicated generally at 34, includes a housing 50 which comprises cover 51, upper body portion 52, and lower body portion 53—all secured by bolts 54. O-ring 56 provides a seal between the upper and lower body portions.

The housing has an interior passage 60 which communicates at its upper end with gasoline conduit 32 through liquid inlet 61, and at its lower end with surge chamber 64 through jet orifice 66 in pilot valve seat 62. Pilot valve seat 62 is sealingly positioned in passage 60 by O-rings 65.

Jet orifice 66 is coaxial with mixing tube 36 along central axis c and communicates therewith through surge chamber 64 adjacent the lower end of housing 50.

Surge chamber 64 communicates at its upper end with vapor conduit 38 through vapor inlet 72.

A vapor pressure regulator diaphragm 74 is clamped around its periphery between cover 51 and upper body portion 52 to define on its opposite sides, together with cover 51 and upper body portion 52, upper and lower chambers 76 and 78 respectively. Lower chamber 78 communicates with surge chamber 64 through bore 80. Upper chamber 78 is vented to the atmosphere through vent 81.

Needle rod 82 is connected at its upper end to disc 84 which is biased upwardly against diaphragm 74 by spring 86. The lower end of needle rod 82 passes through a central bore 83 in pilot valve 88, u-cup 98 providing a seal therebetween. The lower end of needle rod 82 is positioned above jet orifice 66—the needle rod 82, jet orifice 66, and mixing tube 36 being coaxially aligned along central axis c.

Pilot valve 88 is positioned within passage 60 and is biased downwardly against valve seat 62 by spring 90, o-ring 92 providing a seal therebetween. U-cup 94 positioned adjacent the upper end of valve 88 provides a seal between the valve, lower chamber 78, and passage 60.

In operation, vapor recovery dispensing nozzle 18 is placed in the fuel tank of the vehicle to be refueled and fuel pump 22 is activated. A portion of the gasoline output of fuel pump 22 is delivered by conduit 32 to interior passage 60 of liquid jet gas pump 34. Pilot valve 88 is initially biased downwardly by spring 90 against seat 62, O-ring 92 and u-cup 94 providing seals which prevent further flow of the gasoline and, therefore, cause the pressure of the gasoline within passage 60 to rise. Due to the differential sealing areas of u-cup 94 and O-ring 92 (u-cup 94 providing a larger sealing area), the gasoline pressure produces a net upward force on valve 88 acting against spring 90. Spring 90 is sized to prevent upward movement of the pilot valve until the pressure within passage 60 exceeds 12 psig (844 grams per sq. cm.). At this threshold level, the pilot valve moves slightly upwardly, lifting O-ring 92 from seat 62 to break that seal, causing the pilot valve to pop upwardly to an open position due to the upward force provided by the gasoline pressure acting against the remaining net sealing area provided by u-cup 94 (the sealing area provided by u-cup 94 minus the sealing area provided by u-cup 98). Once the pilot valve pops open, it will remain open until the pressure within passage 60 falls below approximately 5 psig (352 grams per sq. cm.), at which point the pressure acting against the net sealing area provided by u-cup 94 will be overcome by the downward force of spring 90 and the pilot valve will close. This operation of the pilot valve makes my jet pump system compatible with fuel dispensing systems which have detection equipment which monitor the system for leaks during an initial pressure buildup.

When pilot valve 88 opens, the gasoline within passage 60 flows through jet orifice 66, drawing vapor from conduit 38, through surge chamber 64, out mixing tube 36, and through pipe 37 into reservoir 10.

The vacuum produced by the liquid jet gas pump is regulated to a predetermined maximum. Upper chamber 76 is maintained at atmospheric pressure by vent 81. Lower chamber 78 communicates with surge chamber 64 through bore 80. As the vacuum level in surge chamber 64 and, therefore, lower chamber 78, increases, vapor pressure regulator diaphragm 74 will produce a downward force acting against spring 86. Spring 86 is sized to support a vacuum level of 16 to 20 inches of water. Any increase of the vacuum above this threshold level will draw the diaphragm 74 downwardly against disc 84, moving needle rod 82 toward jet orifice 66, increasingly blocking the flow of gasoline through the jet orifice and hence decreasing the rate of withdrawal of vapor from and, therefore, the vacuum within surge chamber 64 and vapor conduit 38 until the predetermined maximum vacuum level is obtained.

For normal refueling rates (5 to 10 U.S. gallons—18.9 to 37.8 liters—per minute), the vapor velocity in vapor hose 42 is sufficient (e.g., greater than 1500 feet per minute) to entrain any liquid therein and carry it out of the conduit. At lower refueling rates, the vapor will still percolate through any liquid in the vapor hose.

When the vapor flow from vapor control nozzle 18 and then fuel supply from fuel pump 22 are suddenly shut off, liquid remaining in mixing tube 36 will be drawn up into surge chamber 64 by the residual vacuum therein. The volume of surge chamber 64 is large enough to hold the liquid remaining in the mixing tube—allowing it to drain out once the pressure has stabilized. This prevents liquid from surging into vapor conduit 38 during shutdown.

What is claimed is:

1. A vapor recovery system for use with systems for dispensing volatile liquids, such as liquid fuels, from a reservoir wherein the liquid is pumped under pressure through a hose and discharged through a vapor recovery dispensing nozzle into the inlet of a container such as a fuel tank, the novel vapor recovery system comprising a liquid jet gas pump having its liquid inlet in communication with the pressurized liquid so as to receive a portion thereof, and a vapor conduit having one end in said nozzle and adapted to be placed in communication with the interior of said container when said nozzle is inserted into said inlet and the other end in communication with the vapor inlet of said jet pump, the outlet of said jet pump discharging into said reservoir, whereby vapor displaced from said container as it is filled will be drawn off through said conduit by suction created by the passage of said liquid through said jet pump.

2. The vapor control system of claim 1 wherein said vapor conduit comprises a second hose having a predetermined outer diameter less than the inner diameter of said first hose and disposed within said first hose.

3. The vapor control system of claim 2 wherein said second hose has an inner diameter of about 5/16 inch (0.79 cm.) and an outer diameter of about ½ inch (1.27 cm.).

4. The vapor control system of claim 1 wherein said vapor conduit has a predetermined inner diameter and said liquid jet gas pump generates a predetermined degree of suction, said predetermined inner diameter and said predetermined degree of suction cooperating to produce a vapor velocity in said vapor conduit sufficient to entrain any liquid in said vapor conduit.

5. The vapor control system of claim 4 wherein said vapor conduit has an inner diameter of about 5/16 inch (0.79 cm.) and said jet pump generates a suction in the range of about 16 to about 20 inches (40 to 50 cm.) of water.

6. The vapor control system of claim 1 wherein said liquid jet gas pump includes a pilot valve between said liquid inlet and said outlet.

7. The vapor control system of claim 6 wherein said pilot valve is biased to a closed configuration in absence of a predetermined threshold pressure in said liquid inlet.

8. The vapor control system of claim 1 wherein said liquid jet gas pump includes an interior fuel passage for conducting the fuel through the pump, and a needle valve provided in said passage, said needle valve being biased toward a first position in which delivery of fuel through said fuel passage is substantially unblocked, and said needle valve moving toward a second position increasingly blocking the flow of fuel through said passage as the vacuum produced by said suction in said vapor conduit increases toward a predetermined maximum.

9. A liquid jet gas pump for use in a vapor recovery system of a liquid dispensing unit wherein the liquid is pumped under pressure from a reservoir through a hose and discharged through a vapor recovery dispensing nozzle into the inlet of a container, such as a fuel tank, the vapor displaced from said reservoir being withdrawn through a vapor conduit having one end in said nozzle and adapted to be placed in communication with the interior of said container when said nozzle is inserted into said inlet, the novel jet pump comprising a housing having a liquid inlet in communication with the pressurized liquid so as to receive a portion thereof, and a vapor inlet which communicates with the other end of said vapor conduit, a mixing tube fixed at one end to said housing and communicating with the interior thereof, and communicating at its other end with said reservoir, a surge chamber within said housing adjacent said mixing tube and communicating with said vapor conduit through said vapor inlet, a valve seat having a jet orifice, said valve seat being spaced within said housing adjacent said surge chamber, said jet orifice being positioned over said mixing tube and communicating therewith through said surge chamber, a passage within said housing communicating at one end with said fuel inlet and at its other end with said jet orifice, a pilot valve disposed within said passage, said pilot valve being biased to a closed position against said valve seat in absence of a predetermined pressure within said passage, a needle valve disposed within said passage over said jet orifice, said needle valve biased to a first position in which delivery of fuel from said passage through said jet orifice is substantially unblocked, said needle valve moving toward a second position which increasingly blocks the flow of fuel from said passage through said jet orifice as the vacuum level within said surge chamber increases to a predetermined maximum.

* * * * *